US007638026B1

(12) United States Patent
Willit et al.

(10) Patent No.: US 7,638,026 B1
(45) Date of Patent: Dec. 29, 2009

(54) URANIUM DIOXIDE ELECTROLYSIS

(75) Inventors: James L. Willit, Batavia, IL (US); John P. Ackerman, Prescott, AZ (US); Mark A. Williamson, Naperville, IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 947 days.

(21) Appl. No.: 11/215,202

(22) Filed: Aug. 24, 2005

(51) Int. Cl.
*C25C 3/34* (2006.01)

(52) U.S. Cl. ..... 205/47; 204/243.1; 204/244; 204/247; 205/43

(58) Field of Classification Search ..... 204/243.1, 204/244; 205/47
See application file for complete search history.

(56) References Cited

U.S. PATENT DOCUMENTS 3,117,836 A * 1/1964 Avery et al. ..... 205/47
5,164,050 A * 11/1992 Bertaud et al. ..... 205/47
5,531,868 A * 7/1996 Miller et al. ..... 205/44
6,299,748 B1 * 10/2001 Kondo et al. ..... 205/47
6,689,260 B1 * 2/2004 Ahluwalia et al. ..... 204/247.2
6,767,444 B1 * 7/2004 Miller et al. ..... 205/43
6,911,134 B2 * 6/2005 Dees et al. ..... 205/43
7,011,736 B1 * 3/2006 Miller et al. ..... 205/47
7,090,760 B2 * 8/2006 Seo et al. ..... 205/47

* cited by examiner

*Primary Examiner*—Patrick Ryan
*Assistant Examiner*—William T Leader
(74) *Attorney, Agent, or Firm*—Bradley W. Smith; Daniel D. Park; Paul A. Gottlieb

(57) ABSTRACT

This is a single stage process for treating spent nuclear fuel from light water reactors. The spent nuclear fuel, uranium oxide, $UO_2$, is added to a solution of $UCl_4$ dissolved in molten LiCl. A carbon anode and a metallic cathode is positioned in the molten salt bath. A power source is connected to the electrodes and a voltage greater than or equal to 1.3 volts is applied to the bath. At the anode, the carbon is oxidized to form carbon dioxide and uranium chloride. At the cathode, uranium is electroplated. The uranium chloride at the cathode reacts with more uranium oxide to continue the reaction. The process may also be used with other transuranic oxides and rare earth metal oxides.

9 Claims, 2 Drawing Sheets

Reaction Sequence

| | |
|---|---|
| $3U^{3+} \rightarrow 3U^{4+} + 3e^-$ | Anode rxn 1 |
| $U^{3+} + 3e^- \rightarrow U^0$ | Cathode rxn 1 |
| $U^{4+} + UO_2 \rightarrow 2UO^{2+}$ | Chem rxn |
| $2UO^{2+} + C \rightarrow 2U^{4+} + CO_{2(gas)} + 4e^-$ | Anode rxn 2 |
| $4U^{4+} + 4e^- \rightarrow 4U^{3+}$ | Cathode rxn 2 |
| $UO_2 + C \rightarrow CO_{2(gas)} + U$ | Net reaction |

URANIUM DIOXIDE ELECTROLYSIS

CONTRACTUAL ORIGIN OF THE INVENTION

The United States Government has rights in this invention pursuant to Contract No. W-31-109-ENG-38 between the U.S. Department of Energy and the University of Chicago.

FIELD OF THE INVENTION

This invention is a method for the reduction of uranium oxide present in spent nuclear fuel using a single step process.

BACKGROUND OF THE INVENTION

This invention relates to an electrochemical process and more particularly to an electrochemical cell in which metal-oxides can be reduced to their corresponding metals. This process relies on the dissolution of the metal oxide into an electrolyte and subsequent decomposition or elective electrotransport. Thus, the process requires an electrolyte in which the metal-oxide is soluble.

There is an ongoing problem concerning the treatment of nuclear waste based on uranium oxide nuclear fuel. Currently, the oxide fuel is reduced electro-chemically or by chemically converting lithium to a metal in a molten salt. This head-end reduction step, with the elimination of oxygen, precedes an electrometallurgical process.

This invention relates to a method for the reduction of uranium oxide present in spent nuclear reactor fuels. More specifically, this invention relates to a single step process for the reduction of uranium oxide. Prior technology employed a two step process and two vessels using molten lithium chloride at 650° C. for the reduction of uranium oxide. In the first step, the oxide was chemically reduced to its metallic form by a reductant, lithium metal. Using this process, the uranium oxide to be converted is contained in a fuel basket generally constructed of a stainless steel mesh. Lithium oxide is the byproduct and is dissolved in the melt. In the second step, lithium oxide electrowinning, the dissolved lithium oxide is electrochemically decomposed to metallic lithium and oxygen gas. The recovered lithium and lithium chloride salt are then reused in the first step.

In a later development, a single step process was carried out using a single electrochemical cell. The negative electrode of this cell is the oxide basket itself, the metal oxides are reduced by a electrochemically generated reducing force. Some lithium metal may form simultaneously, but it is consumed immediately in a reaction with the oxide particles. Then, the $Li_2O$, the byproduct of the cathode reaction diffuses from the cathode basket to the anode. At the anode the $Li_2O$ is electrochemically converted to oxygen gas and lithium metal, which is then reused.

In the subject invention, $UO_2$ reacts with $UCl_4$ which is dissolved in a molten LiCl salt bath. The LiCl salt bath may also contain KCl and $UCl_3$ In reacting with the $UCl_4$, the $UO_2$ is converted to $UOCl_2$ which is soluble in the molten LiCl—KCl—$UCl_4$ salt. When a voltage is passed between an anode which may be carbon and is positioned in the $UO_2$ containment vessel and a metallic cathode positioned in the salt bath containing the dissolved uranium chloride, the carbon anode is oxidized to form $CO_2$ gas and $UCl_4$ while at the cathode uranium metal is electroplated on the metallic cathode. During this process, new $UCl_4$ is formed; thus, sustaining the reaction.

Thus, the objective of this invention is to provide a method of processing uranium oxide using a single step process.

Another objective is to employ this method with other transuranic oxides and rare earth metal oxides.

Additional advantages, objects and novel features of the invention will become apparent to those skilled in the art upon examination of the following and by practice of the invention.

SUMMARY OF THE INVENTION

To achieve the foregoing and other advantages, this invention is a method and apparatus for treating spent nuclear fuel through the use of a electrochemical technique which is carried out in one vessel in a single molten salt bath. This technique converts uranium oxide to carbon dioxide and uranium metal. To arrive at this result, $UO_2$ reacts with $UCl_4$ which is dissolved in molten LiCl or LiCl combined with KCl and $UCl_3$. A carbon anode and a metallic cathode are placed in the salt bath and a voltage exceeding 1.3 volts is applied between the anode and cathode. At the anode, the carbon is oxidized to form carbon dioxide and uranium chloride. At the cathode, uranium metal is electrodeposited. The uranium chloride at the anode reacts with more uranium oxide to continue the reaction. In addition, this technique is applicable to carbide fuels that have uranium oxide encased in graphite and SiC. In addition, this apparatus and method would be applicable to conversion of all transuranic oxides and rare earth metal oxides to metal chlorides.

BRIEF DESCRIPTION OF THE DRAWINGS

The present invention is illustrated in the accompanying drawing where.

DETAILED DESCRIPTION OF THE INVENTION

In this invention, $UO_2$ is mixed with a solution of $UCl_4$ dissolved in molten LiCl salt which also contains KCl and $UCl_3$. In this situation, the $UCl_4$ in combination with $UO_2$ will be converted to $UOCl_2$ in a solution of molten LiCl as follows: $UO_2+UCl_4 \rightarrow 2UOCl_2$. If a carbon anode and a metallic cathode are positioned in this solution and a select voltage greater than or equal to 1.3 volts is applied between the anode and the cathode, the following general reaction will result:

$$2UOCl_2+C \rightarrow CO_2(gas)+UCl_4+U$$

At the anode which can be graphite, carbon is oxidized and forms $CO_2$ (gas) and $UCl_4$ or in the alternative, the carbon can come from the fractured pellets. At the cathode, uranium metal is electrodeposited. The $UCl_4$ formed at the anode reacts with more $UO_2$ to form more $UOCl_2$ thus sustaining the reaction. It is also expected that $PuO_2$, $PuO_3$, and $Nd_2O_3$ will react with $UCl_4$ to form $PuCl_3$, $Nd_2Cl_3$ and $UO_2$. Thus, all the transuranic oxides and rare earth oxides will be dissolved in the molten LiCl as chlorides. The molten LiCl bath also generally contains KCl and approximately 50 wt % $UCl_3$ in addition to the LiCl.

Figures 1, 2:
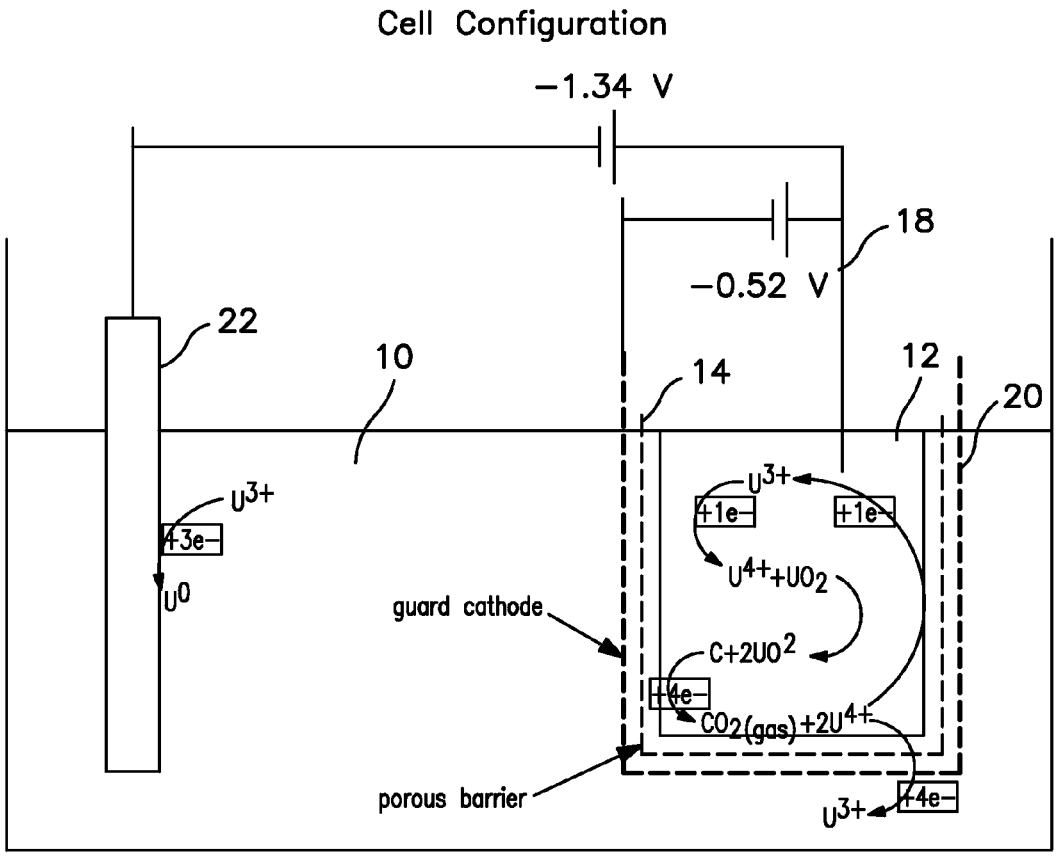
FIG. 1 represents the electrochemical cell configuration.
FIG. 2 represents the reaction sequence for the cell shown in FIG. 1.
Figure 3:
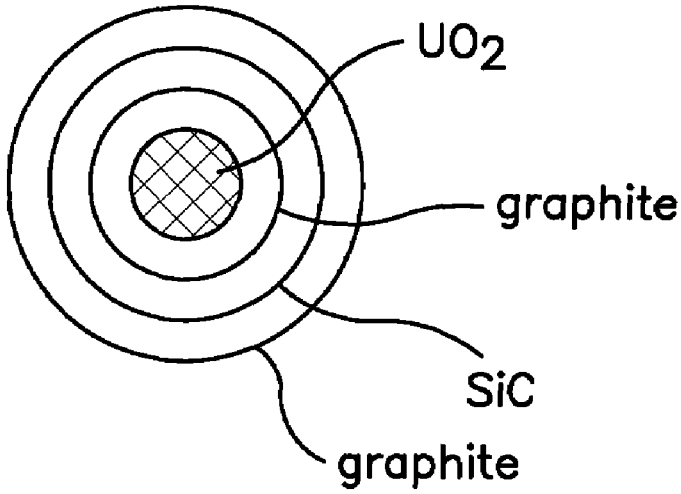
FIG. 3 is a cross section of nuclear fuel pellet.

As is shown in FIG. 1, the $UO_2$ pellets are contained in a vessel 12 which is porous to the various uranium chlorides. Container 12 is further enclosed in a porous barrier 14 which functions to control the passage of ions to and from vessel 12. To move the uranium ions out of the containment area while retaining the $UCl_4$ species within the containment area, a potential is established between the anode 18 and a guard cathode 20. The applied potential is approximately 0.52 volts.

A cathode 22 is positioned in the molten LiCl 10 and a potential of approximately 1.34 volts is applied between anode 18 and cathode 22. This results in the uranium plating out or electroplating on the cathode 22.

The sequence of reactions which lead to the formation of the uranium ions, carbon dioxide and regenerated $UCl_4$ are as follows:

$$4UCl_3 \rightarrow U+3UCl_4$$

$UO_2+UCl_4 \rightarrow 2UOCl_2$ which is soluble in $UCl_4$. Leading to an overall electrochemical reaction of $UOCl_2+C \rightarrow CO_2\uparrow + U+UCl_4$ with the U ion plating out on the cathode.

FIG. 2 illustrates the electron transfer which occurs at the anode 18 and the cathode 22 leading to the net reaction of $$UO_2+C \rightarrow CO_2+U$$

In reaction 1, we have $4UCl_3 \rightarrow U+3UCl_4$ electrochemically forming the $UCl_4$ at the anode which is needed to react with the $UO_2$ in the form $UO_2+UCl_4 \rightarrow 2UOCl_2$ which as referenced before is soluble in $UCl_4$. Then $UOCl_2$ reacts with the carbon to form carbon dioxide at the anode. The uranium is in the valance form indicated in cathode reaction 2.

The anode should be located close to the $UO_2$ to ensure that the $UCl_4$ can react with the $UO_2$ and to shorten the diffusion path for the $UOCl_2$ This method is also applicable to carbide fuel pellets that have $UO_2$ encased in graphite.

This invention offers the direct electrochemical reduction of uranium oxide to uranium metal. The key to this invention is the reaction of $UO_2$ with $UCl_4$ in a molten salt to produce $UOCl_2$ which is soluble in the molten salt. The dissolved $UCl_4$ can then be broken down electrochemically to uranium metal, oxygen (or $CO_2$) and more $UOCl_2$. Because the electrochemical breakdown of $UOCl_2$ produces more $UCl_4$ the chemical reaction and the electrochemical reaction are self-sustaining. In addition to $UO_2$, rare earth oxides and transuranic oxides will react with $UCl_4$ to give $UOCl_2$ and the corresponding rare earth or transuranic chloride. The primary application of this technology will be for the recovery of actinides from light water reactor fuel. Because molten salts are poor moderators for nuclear fission relatively high concentrations of fissile material can be handled safely.

FIG. 1 illustrates a typical apparatus configuration used convert $UO_2$ to U. $UO_2$ pellets are contained in porous container, 12, which can alternately serve as the anode.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments described explain the principles of the invention and practical applications and should enable others skilled in the art to utilize the invention in various embodiments and with various modifications as are suited to the particular use contemplated. It is intended that the scope of the invention be defined by the claims appended hereto.

The embodiment of this invention in which an exclusive property or privilege is claimed is defined as follows:

1. An apparatus for treating spent nuclear fuel by a single step process comprising:

a primary container capable of holding and maintaining LiCl or LiCl in combination with KCl and $UCl_3$ in the molten state;

a primary molten bath of LiCl or LiCl in combination with KCl and $UCl_3$ which fills said primary container to a specified depth;

a second container which is porous to uranium chloride and which is smaller than said primary container and which contains a plurality of spent nuclear fuel pellets or rods and where said second container is immersed in said primary molten bath and where said spent nuclear fuel is covered by a second molten bath having essentially the same composition as said primary molten bath;

a porous barrier which encloses said second container and where a plurality of pores in said porous barrier are sized to allow for the passage of specific ions;

a guard cathode which encloses said porous barrier;

an anode which is positioned in said second container so that a first end of the anode is in the second molten bath and a second end is exposed above a surface of said second molten bath;

a primary cathode which has a first end of positioned in said primary molten bath and a second end which is external to said primary molten bath and where said primary cathode is electrically coupled to said anode through a primary power source;

a secondary cathode which is electrically attached to a portion of said guard cathode at a point which is external to said primary molten bath and which is electrically coupled to said anode through a secondary power source.

2. The apparatus of claim 1 where said primary power source supplies approximately 1.3 volts between said anode and said primary cathode.

3. The apparatus of claim 1 where said secondary power source supplies approximately 0.5 volts between said anode and said guard cathode.

4. The apparatus of claim 1 where said pores of said porous barrier are sized to allow the passage of uranium ions.

5. A method for treating a quantity of spent nuclear fuel using an electrochemical process including:

placing said spent nuclear fuel, which has a core of uranium oxide, in a porous container;

placing a quantity of molten LiCl or LiCl with KCl and $UCl_3$ in a holding container to form a molten bath and where said container is capable of maintaining said bath in the molten condition;

inserting a guard cathode in said molten bath;

inserting a porous barrier in an upper opening of said guard cathode where said guard cathode encircles said porous barrier;

inserting said porous container with said spent fuel in an upper opening of said porous barrier where said porous barrier encircles said porous container thus creating a nesting of the guard cathode, the porous barrier and the porous container;

filling said porous container with material from said molten bath;

inserting an anode in the molten material contained in said porous container;

electrically connecting said anode to a primary cathode positioned outside of said guard cathode and partially suspended in said molten bath to form an anode-primary cathode circuit;

electrically connecting said anode to said guard cathode to form a anode-guard cathode circuit;

inserting a power source in the anode-primary cathode circuit;

inserting a secondary power source in the anode-guard cathode circuit;

collecting uranium which has electroplated on said primary cathode.

6. The method of claim 5 which includes selecting a voltage output of approximately 0.5 volts for said anode-guard cathode circuit.

7. The method of claim 5 which includes selecting a voltage output of approximately 1.3 volts for said anode-primary cathode circuit.

8. The method of claim 5 which includes venting off carbon dioxide produced by the electrochemical reaction.

9. The method of claim 5 where the spent nuclear fuel comprises a transuranic oxide other than uranium oxide.

* * * * *